United States Patent [19]

Hoffmüller et al.

[11] 4,323,394

[45] Apr. 6, 1982

[54] METHOD FOR MANUFACTURING TURBOROTORS SUCH AS GAS TURBINE ROTOR WHEELS, AND WHEEL PRODUCED THEREBY

[75] Inventors: Wilhelm Hoffmüller, Munich; Axel Rossmann, Karlsfeld; Franz Schreiber, Meitingen-Herbertshofen, all of Fed. Rep. of Germany

[73] Assignee: Motoren-und Turbinen-Union Munchen GmbH, Munich, Fed. Rep. of Germany

[21] Appl. No.: 63,714

[22] Filed: Aug. 6, 1979

[51] Int. Cl.[3] ..... B22F 5/00; B22F 7/00

[52] U.S. Cl. ..... 75/208 R; 75/226; 75/200; 75/211; 416/213 R; 416/215; 29/156.8 R

[58] Field of Search ..... 75/200, 226, 208 R, 75/211; 416/213 R, 215; 29/156.8 R

[56] References Cited

U.S. PATENT DOCUMENTS

| | | | |
|---|---|---|---|
| 3,784,320 | 1/1974 | Rossman | 416/215 |
| 4,063,939 | 12/1977 | Weaver et al. | 29/156.8 R |
| 4,096,120 | 6/1978 | Grunke | 29/156.8 R |
| 4,097,276 | 6/1978 | Six | 75/208 R |
| 4,214,906 | 7/1980 | Langer et al. | 416/213 R |

*Primary Examiner*—Brooks H. Hunt

*Attorney, Agent, or Firm*—Craig and Antonelli

[57] ABSTRACT

A method for manufacturing turborotors such as gas turbine rotor wheels having blades of a ceramic material enables an improved rotor wheel to be produced by forming a blade-to-disk connection by sintering the roots of the blades in place within the rotor disk. According to one embodiment, premanufactured blades are joined to the rotor by sintering the entire rotor disk to the premanufactured blades, while in a second embodiment, premanufactured blades are joined to a premanufactured disk by a sintered connection. To compensate for different thermal expansions between the blade and the sintering material, a ductile material is applied to the blade roots before sintering. This ductile material is applied as a coating made of metallic powders, or as a metal felt.

19 Claims, 6 Drawing Figures

METHOD FOR MANUFACTURING TURBOROTORS SUCH AS GAS TURBINE ROTOR WHEELS, AND WHEEL PRODUCED THEREBY

BACKGROUND AND SUMMARY OF THE INVENTION

This invention relates to a method for manufacturing turborotors and, more particularly, this invention relates to a method for manufacturing gas turbine rotor wheels, and the improved rotor wheel resulting therefrom.

The problem encountered in the manufacture of highly stressed gas turbine rotor wheels is posed by the requirement for high strength at extremely high temperatures (1200° C. and over). It has been found that hot strength properties like these are exhibited by ceramic or quasi-ceramic materials only, and it has therefore been attempted to manufacture such gas turbine wheel from ceramic materials. However, it was found that one-piece, fully ceramic gas turbine wheels will be destroyed as a result of thermal cracking under the elevated-temperature alternations of such gas turbine wheels. The ideal solution, therefore, would be gas turbine wheels where the rotor disk is made of materials that are highly resistant to thermal shock, while the blades are made of highly heat-resistant, preferably ceramic materials. Such a combination has in the past been difficult if not impossible to implement because all efforts securely attach ceramic or quasi-ceramic blades to a disk have failed. The lack of ductility of said ceramic materials or of cast, highly heat-resistant alloys keep the bearing contours of disk and blade root from matching perfectly, and this in turn causes extremely high concentrated loads destroying the blades.

Therefore, in a broad aspect, the present invention has for an object to provide a method for manufacturing turborotors where a durable blade-to-disk connection is achieved at reasonable expense.

It is a particular object of the present invention to provide a method by which the blade-to-disk connection is made by sintering the blade roots in place in the rotor disk.

The method according to the present invention provides a great advantage in that sintering achieves homogeneous support of the blade roots in the disk, so that load concentrations are avoided and use can be made, therefore, of very brittle blade materials.

In a preferred embodiment of the present invention the blade-to-disk connection is made by sintering the entire rotor disk while using premanufactured blades. In this embodiment of the present invention the premanufactured blades are inserted in circular succession in a die corresponding to the contour of the rotor disk, and after adding the sintering material the disk is sintered or hot-pressed to enclose the blade roots.

In a further embodiment of the present invention a one-piece bladed wheel is cast in a galvanoplastically made mold and then placed in a die for sintering the disk.

The inventive concept naturally also embraces gas turbine wheels made of premanufactured rotor disks having a cavernous recess for each blade, in which recess the blade root is inserted together with sintering material for sintering.

In a preferred aspect of the present invention the blades are cast blades of highly heat resistant materials.

The method of the present invention affords a particular advantage when it is intended to join ceramic blades, especially silicon ceramic blades, to a rotor disk, for the reason that, as previously described, there have been practically no reliable ways of attaching such ceramic blades to rotor disks. Imbedding such ceramic blades in the sintering material will eliminate stress concentrations that in the operation of said turborotors carry special risk for ceramic materials.

According to a further feature of the present invention the blade roots are coated with a ductile material before they are sintered in place in the rotor disk. Said coating serves to balance the widely different thermal expansions between the blade and the sintering material, so that excessive compressive stresses at the interface of disk and sintering material are prevented. As a coating material use is preferably made of metallic powders, such as niobium applied on the roots by metal spraying or in the form of aqueous solutions using a binding agent. Zirconium oxide has likewise proved to be of value as a coating material.

Another approach to preventing excessive compressive stresses as a result of widely different thermal expansions between the blade material and the sintering material, according to the invention, is to cover the blade roots with metal felt before sintering. The metal felt will then be sintered in place together with the root to serve, as do said coating materials, as a compressible cushion.

Sintering is preferably effected at a temperature somewhat below the recrystallization point, and the time at temperature will be minutes to hours, depending on the temperature used.

In a preferred aspect of the present invention the sintering pressure ranges from approximately 5,000 to 10,000 $N/cm^2$.

A further advantage benefiting the strength of the blade-to-disk connection has been found to be provided when the lower portion of the blade root widens in pear-shaped manner in at least one plane, and space permitting, a pear-shaped widening provided in both an axial and a radial plane will create an even greater advantage. In this manner, the blade root will be surrounded and clamped on all sides for particularly good support of the blade.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
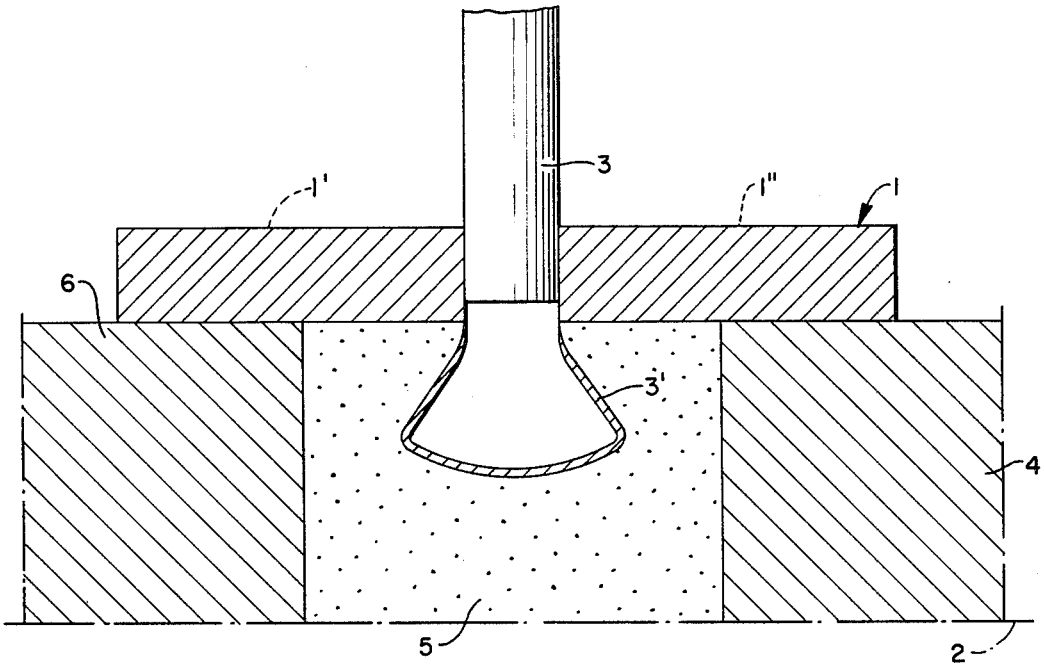
FIG. 1 is a schematic arrangement for sintering a whole turbine disk using a premanufactured blade.

With reference now to FIG. 1, a cylindrical die in which a rotor wheel is sintered is indicated by the numeral 1, and its centerline by the numeral 2. The cylindrical die 1 exhibits circumferentially arranged openings through which blades 3 are inserted from below in circular succession. The blades 3 are preferably made of highly heat-resistant and brittle materials such as ceramics. The blade roots projecting into the interior of the cylindrical die 1 are completely enclosed by sintering material 5 which also constitutes the rotor disk after sintering. The cylindrical die 1 may optionally be closed on one side 4 and have a ram 6 on the other, or both sides 4 and 6 may be movable rams.

Figure 2:
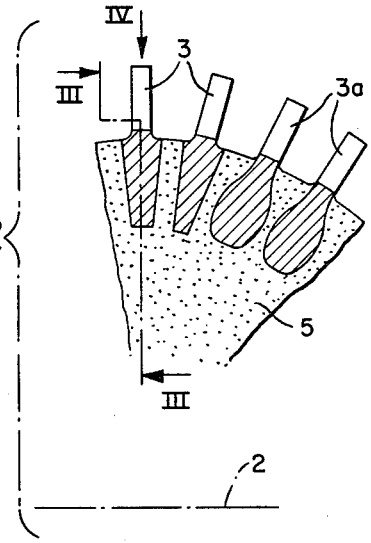
FIG. 2 is a sectional view illustrating a finished turborotor after sintering.

The blade 3, in FIG. 1, can either be one of a series of separate circumferentially spaced individual blades (e.g., as shown in FIG. 2) or blade 3 may form a part of a single cast row of blades formed as a blade ring, each of the blades being interconnected by a common root portion. For use of a cast blade ring, the cylindrical die 1 can be divided into two axial parts (represented by the dash line numerals 1', 1'') along a line passing through the circumferentially spaced blade openings. Alternatively, adaptors having a height at least as great as that of the blades can be inserted between all of the blades and then a one-piece die ring 1 can be placed thereover so as to hold all of the adaptors and blade ring.

Whether a single cast blade ring of a plurality of individual blades are utilized, it is desirous to have the root(s) of the blades 3 coated with an adequately ductile material 3' which preferably has a coefficient of thermal expansion near that of the blade material so as to prevent damage due to excessive compressive stresses resulting from widely different degrees of thermal expansion with respect to the blade material and the sintering material.

The material 3' may be made as a coating of metallic powders, such as niobium applied on the roots by metal spraying, or in the form of an aqueous solution using a binding agent. Another suitable coating material is zirconium oxide. Alternatively, a metal felt such as described in U.S. Pat. No. 3,784,320 can be applied to the blade roots before sintering. Due to the ductility of the felt, it is sufficient that the felt is laid around the blade root, but the metal felt can be glued by means of a ceramic adhesive. The metal felt is sintered in place together with the root of the blade.

Whichever approach is used to apply a ductile material 3' to the blade root, the material functions as a compressible cushion to prevent excessive compressive stresses at the interface of the disk and sintering material due to different thermal expansion ratios and thereby prevents damage which would otherwise result.

As sintering materials, use is preferably made of nickel-base alloys preferably containing 45 to 65% nickel by weight. It has been shown that a special advantage is provided by a sintering material of the following composition:

| | | | |
|---|---|---|---|
| (a) about | Co 18 | or (b) about | Co 13 |
| | Cr 16 | | Cr 8 |
| | Mo 5.5 | | Al 5 |
| | Al 4.1 | | Ti 4.5 |
| | Ti 3.6 | | Mo 2 |
| | Fe 05 | | Ni remainder |

-continued

| |
|---|
| Ni remainder |

For manufacturing the turbine rotor according to the FIG. 1 arrangement, the sintering material is heated to its sintering temperature and the intended pressure (e.g. 5,000 to 10,000 N/cm$^2$) is then applied using the ram 6 or rams 4, 6.

Figure 3:
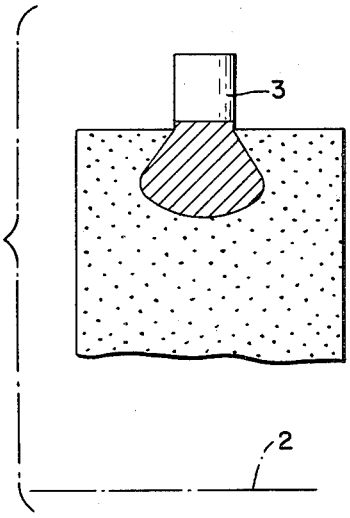
FIG. 3 is a sectional view taken at line III—III of FIG. 2.
Figure 4:
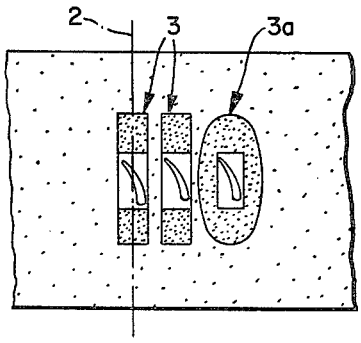
FIG. 4 is a view in the direction of arrow IV of FIG. 2.

FIGS. 2, 3 and 4 illustrate root shapes which are useable for connecting the blade to the sintered rotor 5 to best advantage. The turbine rotor illustrated in fragmentary view in FIGS. 2 to 4 again consists of a rotor disk 5 that was sintered as a whole to premanufactured blades 3. As it will become apparent from the view of FIG. 4 and the longitudinal section of FIG. 3 the roots of blades 3 take a widened, pear-like shape in an axial plane only, whereas the alternative embodiment of the blades **3*a*** have roots the lower ends of which grow thicker in a pear-shaped manner in both an axial plane and a radial plane. When a cast blade ring is used only an axial pear-shaped cross-section can be used, this configuration being produceable such as by galvanoplastically molding the blade ring (i.e., a conventional method whereby a mold is formed of a conductive material that has been electro-coated onto a model).

Figure 5:
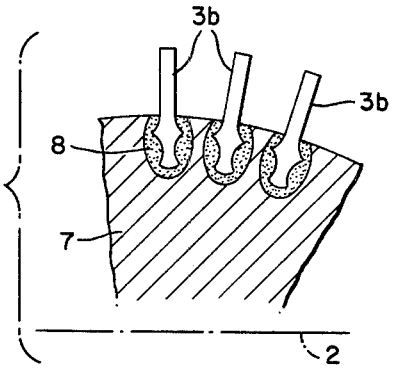
FIG. 5 is an alternative embodiment according to the invention.

The sectional view of the rotor in FIG. 5 illustrates an embodiment in which the blade-to-disk connection is achieved by sintering premanufactured blades **3*b* in a premanufactured rotor disk 7. To this end, the outer circumference of the premanufactured rotor disk 7 is provided with recesses 8**, each of which is large enough to accommodate a shaped blade root plus the sintering material surrounding it.

The blades **3*b*, in FIG. 5, are shown having concave recesses extending along their roots. However, the root shapes of FIGS. 2–4 can be used in accordance with this embodiment as well. Likewise, a ductile material and sintering material as described above can be used in conjunction with the FIG. 5** arrangement.

Figure 6:
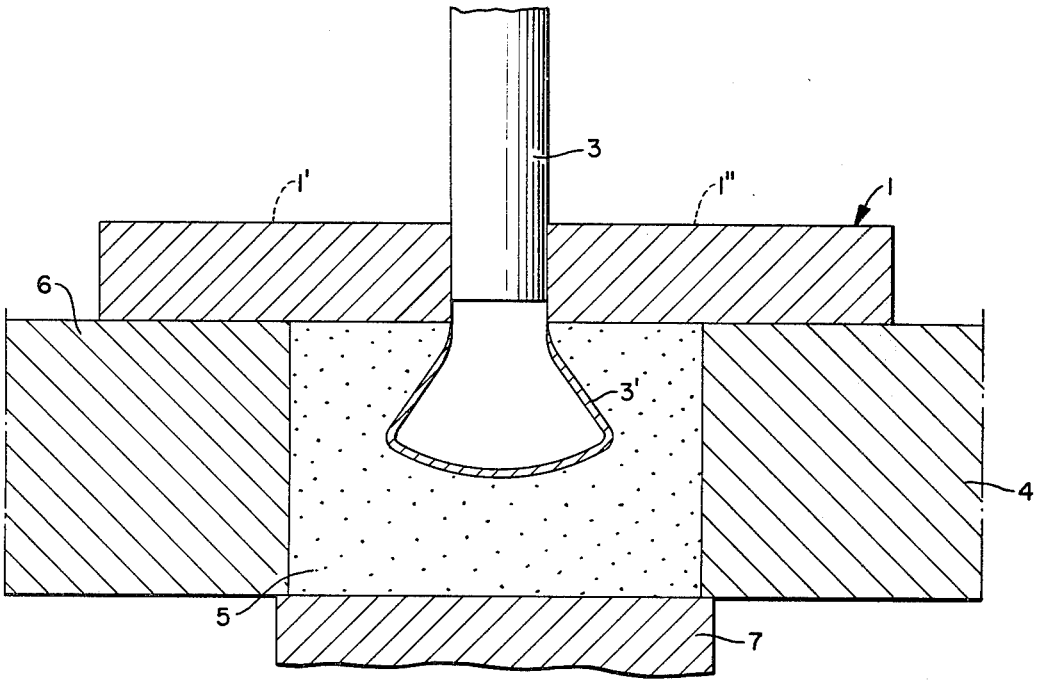
FIG. 6 is a schematic arrangement for sintering in accordance with the FIG. 5 embodiment.

One method by which the FIG. 5 arrangement can be formed with a sintered connection between premanufactured blades **3*b* and a premanufactured rotor disk 7 can be achieved by forming the recesses 8 so that they extend completely across the rotor disk in the axial direction so as to provide at least one lateral opening through which a pressure ram can exert a compressive force. To apply such a compressive force, the pressure ram or rams are configured so as to have the shape of the recesses 8, whereby they may extend therein as illustrated in FIG. 6**. Alternatively, a galvanoplastic mold could be formed for the sintering material that is broader than the rotor disk, with the sintering operation being performed therein.

While we have shown and described various embodiments in accordance with the present invention, it is understood that the same is not limited thereto but is susceptible of numerous changes and modifications as shown to those skilled in the art and we therefore do not wish to be limited to the details shown and described herein but intend to cover all such changes and modifications as are encompassed by the scope of the appended claims.

We claim:

1. Method for manufacturing turborotors, such as gas turbine wheels, comprising the steps of (1) inserting a root portion of turbine blades within a cavernous recess area of a pre-manufactured rotor disk with the root portion spaced from wall portions of said disk defining the recess area; (2) inserting a powdered connection material between said root portion and wall portions; and (3) sintering said connection material for joining said root portion of the blades to the rotor disk.

2. Method of claim 1, wherein the blades are ceramic or silicon ceramic blades and comprising the step of coating the blade root portion with a ductile material before they are sintered in place in the rotor disk by said connection material, whereby widely differing thermal expansions between the blade material and said connection material are balanced.

3. Method of claim 1, wherein the blades are interconnected into a pre-manufactured blade ring by a common root portion.

4. Method of claim 1, wherein the step of sintering said connection material is performed with said blades supported within a cylindrical die and by axial reciprocation within said recess area of at least one ram of a shape corresponding to that of the recess area.

5. Method for manufacturing turborotors, such as gas turbine wheels, comprising the step of joining a common root portion of a pre-manufactured cast blade ring having a row of blades within a rotor disk by sintering a connection material about the root portion, wherein the blades are ceramic or silicon ceramic blades and comprising the step of coating the blade root portion with a ductile material before they are sintered in place in the rotor disk by said connection material, whereby widely differing thermal expansions between the blade material and said connection material are balanced.

6. Method of claim 5, characterized in that the joining of the blade root portions to the rotor disk is performed by sintering the entire rotor disk to premanufactured blades.

7. Method of claims 5 or 1 or 3, characterized in that the method is performed using a material made of nickel-base alloys containing 45 to 65% nickel by weight as said connection material.

8. Method of claim 2 or 5, characterized in that as a coating material, use is made of a metallic powder.

9. Method of claim 8, characterized in that as a coating material, use is made of niobium.

10. Method of claim 2, characterized in that as a coating material, use is made of zirconium oxide.

11. Method of one of claims 5 or 1, characterized in that sintering is effected at a temperature somewhat below that of recrystallization.

12. Method of one of claims 5 or 3, wherein said joining by sintering a connection is performed with said blades being supported in position within a cylindrical die by axial reciprocation of at least one ram so as to effectuate sintering of material disposed within said die and about said blade roots.

13. A turbine wheel produced by the method of one of claims 5 or 3.

14. Method of claim 5 or 1 or 3, characterized in that the lower portion of blade root widens in a pear-fashioned manner in at least one plane.

15. A turbine wheel comprising a rotor disk and a blade ring having a plurality of turbine blades of a ceramic material, said blade ring being secured within said rotor disk by material sintered between said rotor and said blade ring about common root portions of the blades.

16. A turbine wheel according to claim 15, wherein a layer of ductile material is disposed about said root portions.

17. A turbine wheel according to claim 16, wherein said ductile material is a coating of metallic powder.

18. A turbine wheel according to claim 16, wherein said ductile material is a metal felt.

19. Method of claim 2 or 5, wherein said ductile material is a metal felt.

* * * * *